US006836077B2

(12) United States Patent
Nerone

(10) Patent No.: US 6,836,077 B2
(45) Date of Patent: Dec. 28, 2004

(54) ELECTRONIC ELIMINATION OF STRIATIONS IN LINEAR LAMPS

(75) Inventor: Louis R. Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 239 days.

(21) Appl. No.: 09/681,994

(22) Filed: Jul. 5, 2001

(65) Prior Publication Data

US 2003/0015970 A1 Jan. 23, 2003

(51) Int. Cl.[7] ..... H05B 37/00
(52) U.S. Cl. ..... 315/209 R; 315/224; 315/219
(58) Field of Search ..... 315/291, 219, 315/209 R, 224, 276, 244, DIG. 5

(56) References Cited

U.S. PATENT DOCUMENTS

| | | | | |
|---|---|---|---|---|
| 4,415,839 A | * | 11/1983 | Lesea | 315/308 |
| 4,723,098 A | * | 2/1988 | Grubbs | 315/306 |
| 5,001,386 A | * | 3/1991 | Sullivan et al. | 315/219 |
| 5,057,721 A | * | 10/1991 | Miyazaki et al. | 307/571 |
| 5,744,915 A | * | 4/1998 | Nilssen | 315/DIG. 5 |
| 5,880,562 A | * | 3/1999 | Nakagawa et al. | 315/224 |
| 6,031,699 A | | 2/2000 | Dollar, II et al. | 361/42 |
| 6,088,205 A | | 7/2000 | Neiger et al. | 361/42 |
| 6,121,732 A | * | 9/2000 | Parker et al. | 315/209 R |
| 6,194,840 B1 | * | 2/2001 | Chang | 315/224 |
| 6,195,241 B1 | | 2/2001 | Brooks et al. | 361/42 |
| 6,229,679 B1 | | 5/2001 | Macbeth | 361/42 |
| 6,239,962 B1 | | 5/2001 | Seymour et al. | 361/115 |
| 6,259,996 B1 | | 7/2001 | Haun et al. | 702/58 |
| 6,262,871 B1 | | 7/2001 | Nemir et al. | 361/42 |
| 6,275,044 B1 | | 8/2001 | Scott | 324/536 |

OTHER PUBLICATIONS

Stan Gibilisco, TAB Encyclopedia of Electronics for Technicians and Hobbyists, pp. 101 and 919.*

* cited by examiner

*Primary Examiner*—Wilson Lee
(74) *Attorney, Agent, or Firm*—Fay, Sharpe, Fagan, Minnich & McKee, LLP

(57) ABSTRACT

The present invention provides a ballast circuit powered by a system power source. The ballast, in operative connection with the system power source, is an inverting type of ballast designed to generate an asymmetric alternating lamp input current on a lamp input line. Further, a gas discharge lamp is in operative connection to the lamp input line configured to receive the asymmetric alternating current. The inverting circuit of the ballast is configured with complementary switches configured to have unequal on times, thereby producing an asymmetric lamp input current. A DC blocking capacitor is provided to block any DC current from the lamp input line. The asymmetric alternating lamp input current eliminates visual striations otherwise occurring in the lamp.

11 Claims, 4 Drawing Sheets

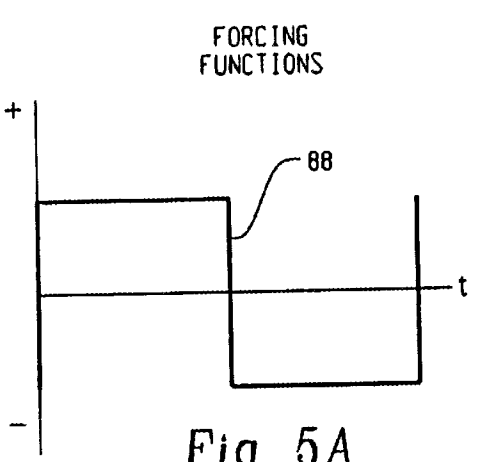
Fig. 5A
PRIOR ART
Fig. 6A
PRIOR ART
Fig. 5B
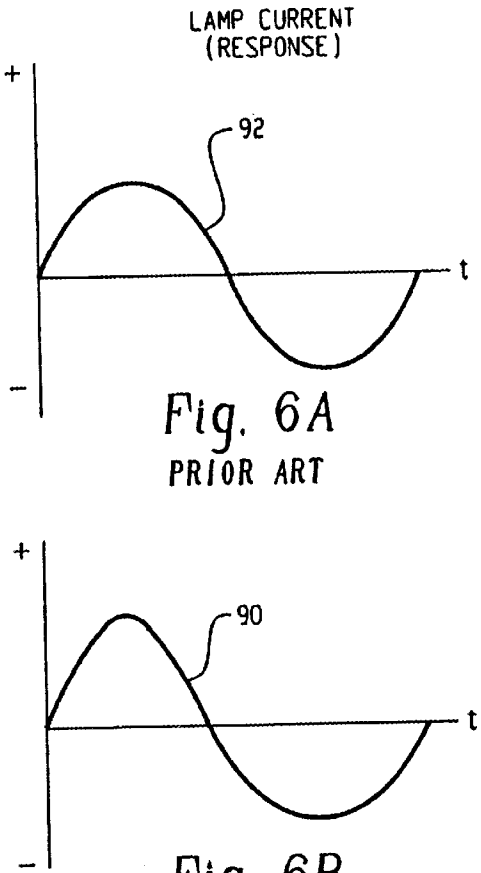
Fig. 6B
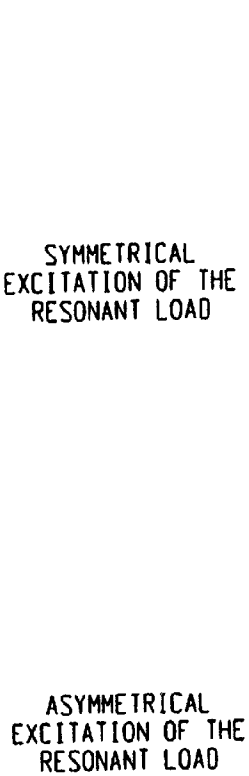

ELECTRONIC ELIMINATION OF STRIATIONS IN LINEAR LAMPS

BACKGROUND OF THE INVENTION

The present invention is directed to improving the visual appearance of linear fluorescent lamps, and more particularly, to the elimination of visual striations which may occur in gas discharge lamps. Generally, a gas discharge lamp will have an elongated gas-filled tube having electrodes at each end. A voltage between the electrode accelerates the movement of electrons. This causes the electrons to collide with gas atoms producing positive ions and additional electrons forming a gas plasma of positive and negative charge carriers. Electrons continue to stream toward the lamp's anode and the positive ions toward its cathode sustaining an electric discharge in the tube and further heating the electrodes. The electric discharge causes an emission of radiation having a wavelength dependent on the particular fill gas and the electrical parameters of the discharge.

A fluorescent lamp is a gas discharge lamp in which the inner surface of the tube is coated with a fluorescent phosphor. The phosphor is excited by the ultraviolet radiation from the electric discharge and fluoresces, providing visible light.

During operation of a gas discharge lamp, such as a fluorescent lamp, a phenomenon known as striations can occur. Striations are zones of light intensity, appearing as dark bands. This phenomenon can give a lamp an undesirable strobing effect. An example of the striation phenomenon is shown in FIG. 1, which depicts a linear fluorescent lamp 10 employing Krypton added as a buffer gas to improve the efficacy of the lamp. In FIG. 1, lamp 10 has striation zones 12 which appear as the dark bands moving along the length of the lamp. Striations in gas discharge lamps are known to occur in cold applications and in other contexts such as Krypton content lamps.

A variety of theories as to why striations occur have been set forth. For example, in U.S. Pat. No. 5,001,386 to Sullivan, it is stated that striations are believed to occur as a result of high-frequency currents re-enforcing a standing wave of varying charge distribution between the lamp electrodes.

Sullivan attempts to solve the striation problem by injecting a dc component superimposed on top of a driving ac current. A disadvantage to this technique is that, by adding the dc bias, it is possible to cause damage to the lamp by moving mercury in the lamp to one end, creating an unbalanced light output. It has also been suggested that increasing the crest factor in a lamp lighting system will eliminate the usual striations. However, increasing the crest factor may also increase the stress on a lamp, which will lead to a shorter lamp life.

Therefore, it would be beneficial to provide a ballast that solves the above-described problems without adding a dc bias and without substantially increasing the crest factor.

SUMMARY OF INVENTION

The present invention provides a ballast circuit powered by a system power source. The ballast is in operative connection with the system power source wherein the ballast is designed to convert the AC system power source to a DC voltage on a DC bus included within the ballast circuit. An inverter circuit is included in the ballast circuit in operative connection with the DC bus to generate an asymmetric alternating current on a lamp input line. Further, a gas discharge lamp is in operative connection to the lamp input line, configured to receive the asymmetric alternating current, thereby eliminating visual striations otherwise occurring in the lamp.

BRIEF DESCRIPTION OF DRAWINGS

FIG. 5*a* shows a standard forcing function which may be obtain by a prior art system;

FIG. 5*b* depicts an input forcing function obtained by use of the concepts of the present invention;

FIG. 6*a* shows a standard lamp input current;

FIG. 6*b* depicts a lamp input current obtained by use of the concepts of the present invention.

DETAILED DESCRIPTION

Figure 1:
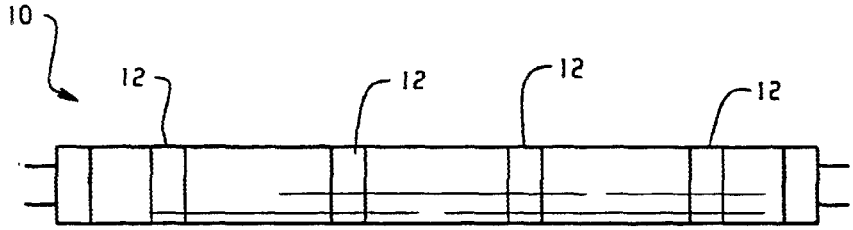
FIG. 1 illustrates a typical fluorescent lamp having striation zone creating a strobing effect to an end user.
Figure 2:
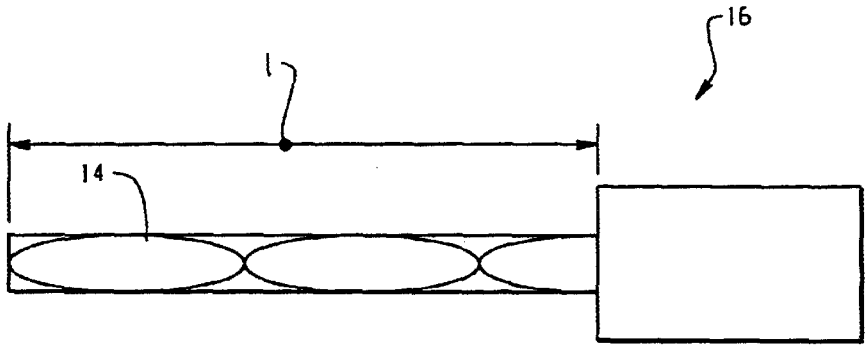
FIG. 2 illustrates a standing pressure wave in a closed organ pipe.

As depicted in FIG. 1, the striation zones 12 generate an undesirable visual effect to an end user. In addressing this problem, the inventors applied a null hypothesis to describe the striation phenomenon, and propose the physics behind striations can be modeled as a standing pressure wave 14 in an enclosed organ pipe 16, such as shown in FIG. 2. The frequency of resonance for a closed pipe is given by:

$$f_n = \frac{n}{4l}\sqrt{\frac{\frac{C_P}{C_v}P_0}{\rho_0}}$$

where l is length unit, n is harmonic, $c_p$ is molar capacity as constant volume, $c_v$ is molar capacity at constant pressure, $P_0$ is undisturbed gas pressure and $D_0$ is density of gas outside compression zone.

Using this hypothesis, it has been determined that striations in a lamp can be reduced or eliminated by operating a ballast having an inverter at other than a 50% duty ratio. That is, in a two switch inverter, for example, one switch is configured to operate longer than the remaining switch. As long as this offset in the duty ratio is blocked, such as by capacitor, no DC current will flow through the lamp's arc. Rather, for example, the positive portion of the lamp current cycle will have a shorter duration but a higher amplitude than the succeeding negative portion of the cycle, or vice versa. Consequently, a ballast circuit has been developed which provides an asymmetric input current to the lamp. By altering the symmetry of the current in this manner, the repetitive resonance frequencies which are believed to create the striations are interfered with thereby eliminating the visual appearance of striations.

Figure 3:
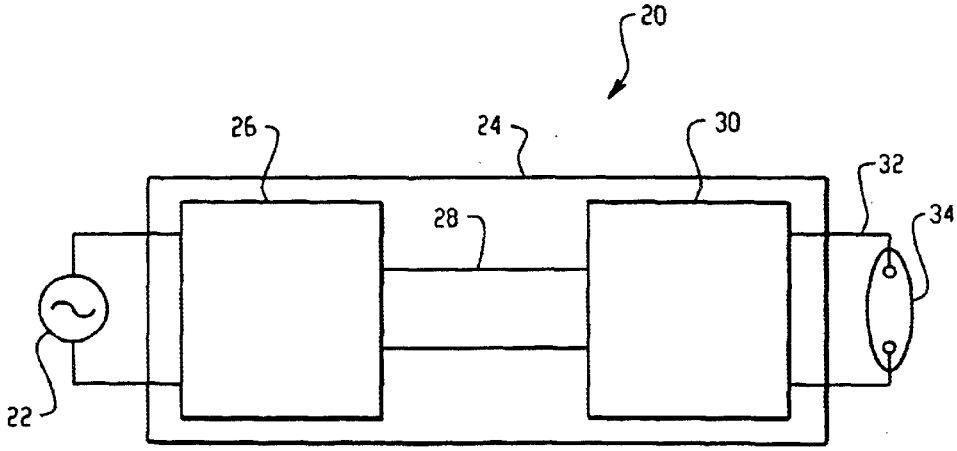
FIG. 3 depicts a high-level view of a system implementing the concepts of the present invention.

FIG. 3 sets forth an exemplary lamp lighting system 20 which incorporates the concepts of the present invention. An input power source 22 supplies power to a ballast 24. Ballast 24 includes an AC-to-DC converter 26 which provides a DC voltage on DC bus 28 which, in turn, provides power to a lamp input current generating circuit 30. The lamp input current generating circuit 30 is configured to generate an asymmetric alternating current on lamp input line 32 that provides power to gas discharge lamp 34. In one embodiment, the lamp input current generating circuit 30 can be an inverter circuit or portions of the investor circuit, and will be described primarily with this focus. However, it is to be appreciated that other components and circuits capable of generating or supplying an a symmetric alternating current to lamp 34 may also be used. These additional circuits, which may be represented by block 30 of FIG. 3, may or may not be part of the inverting circuit. For example, a sub-circuit subsequent to the inverting mechanism can be used to alter asymmetric generated signal into an asymmetric form.

Figure 4:
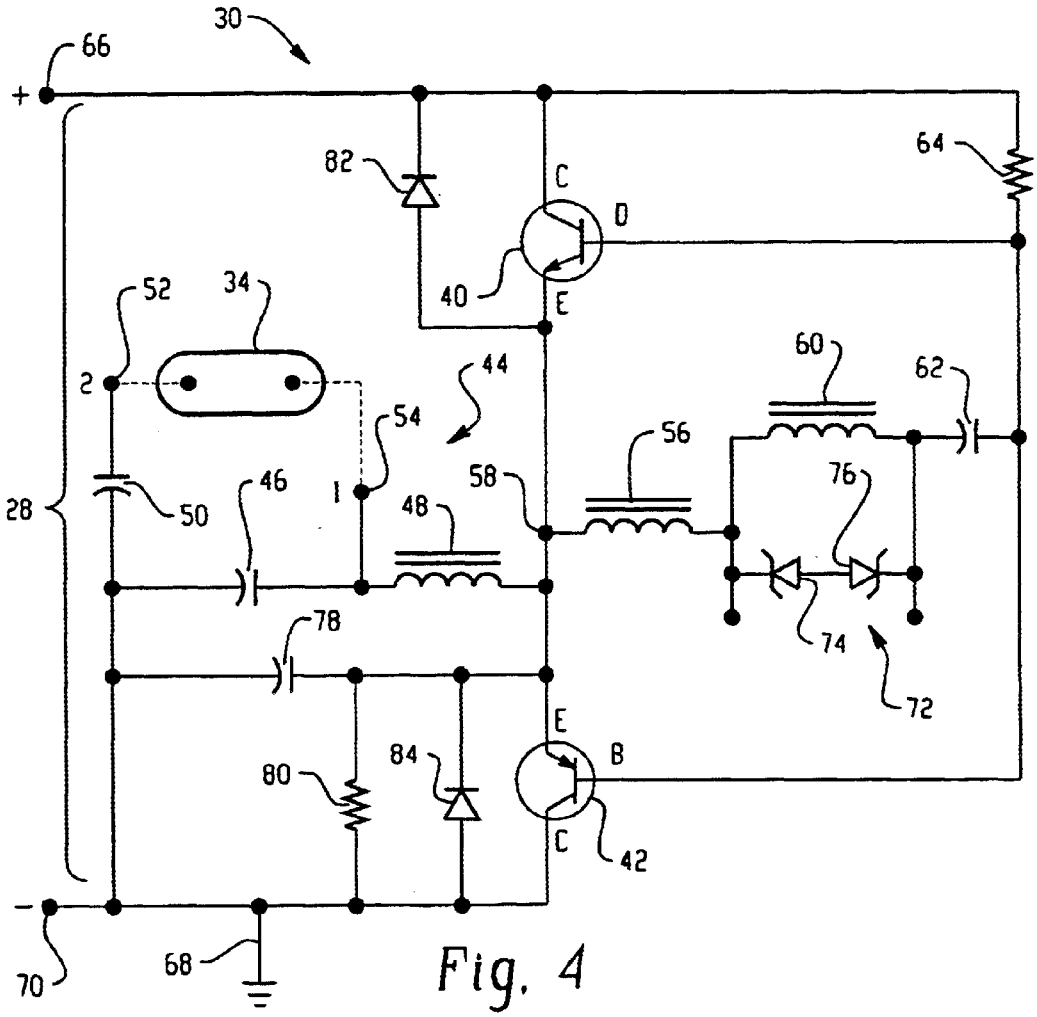
FIG. 4 illustrates a preferred embodiment of the present invention.

Set forth in FIG. 4 is one embodiment of inverter circuit 30 suitable for incorporating concepts of the present invention. Inverting circuits of this type are well known in the industry and, therefore, the circuit will not be described in great detail except where concepts of the present invention are implemented. The circuit comprises complementary switches 40 and 42, bipolar junction transistors in this exemplary embodiment. The emitters of switches 40 and 42 are connected in common to a series configured resonant circuit 44 including capacitor 46 and inductor 48. A blocking capacitor 50 is connected to the remaining end of resonant circuit 44 and is series connected to lamp 34 at node 52 with the remaining end of lamp 34 connected to the junction of capacitor 46 and inductor 48 at node 54. A feedback inductor 56, a tap from inductor 48, is connected to the common emitters of switches 40 and 42 at node 58 with the remaining end of inductor 56 series connected to driving inductor 60 which is connected, in turn to feedback capacitor 62. The remaining end of feedback capacitor 62 is connected to the base terminals of switches 40 and 42. A first resistor 64 is connected from the base terminals of switches 40 and 42 to the collector terminal of switch 40 which is also connected to the positive lead of DC bus 28 at node 66. The collector terminal of switch 42 is connected to ground 68 which is connected to the negative lead of DC bus 28 at node 70. Driving inductor 60 is bridged by output clamping circuit 72 comprising back-to-back, series connected zener diodes 74 and 76. Capacitor 78 bridges resonant circuit, and resistor 80 is connected between node 58 and ground 68. Reverse-conducting diode 82 bridges the emitter and collector terminals of switch 40, with the cathode of diode 82 connected to the collector terminal of switch 40. Reverse-conducting diode 84 bridges the emitter and collector terminals of switch 42, with the anode of diode 84 connected to the collector terminal of switch 42. A preferred method of producing asymmetry in the lamp input current for the circuit illustrated in FIG. 4 is to configure switches 40 and 42 with mismatched $h_{FE}$ (commonly called beta). This causes the transistor with a lower $h_{FE}$ to conduct for a shorter period of time, thereby causing the on time of switches 40 and 42 to be asymmetrical. That is, one BJT will conduct for a shorter period of time than the other will.

FIG. 5*b* shows an asymmetrical forcing function 86 of the present invention compared to a typical symmetrical forcing function 88 of FIG. 5*a* of prior art ballast inverters. The forcing function is a voltage as measured from node 58 with respect to node 52 in FIG. 4. The particular forcing function shown is configured to have a short positive duration and a long negative duration. The positive and negative durations can be reversed with equal efficacy.

FIG. 6*b* illustrates the effect of asymmetrical forcing function 86. Asymmetrical load current 90, measured as the current flowing from node 54 to node 52, and can be compared to a symmetrical load current 92 shown in FIG. 6*a*. The positive portion of the asymmetrical current cycle is of shorter duration than the negative portion of the cycle, however, the positive portion is of a higher amplitude than the negative portion. Symmetrical load current 92, however, shows equal positive and negative durations, and equal positive and negative amplitudes. There is no DC component to asymmetrical load current 90 because DC current is blocked by blocking capacitor 50.

Figure 7:
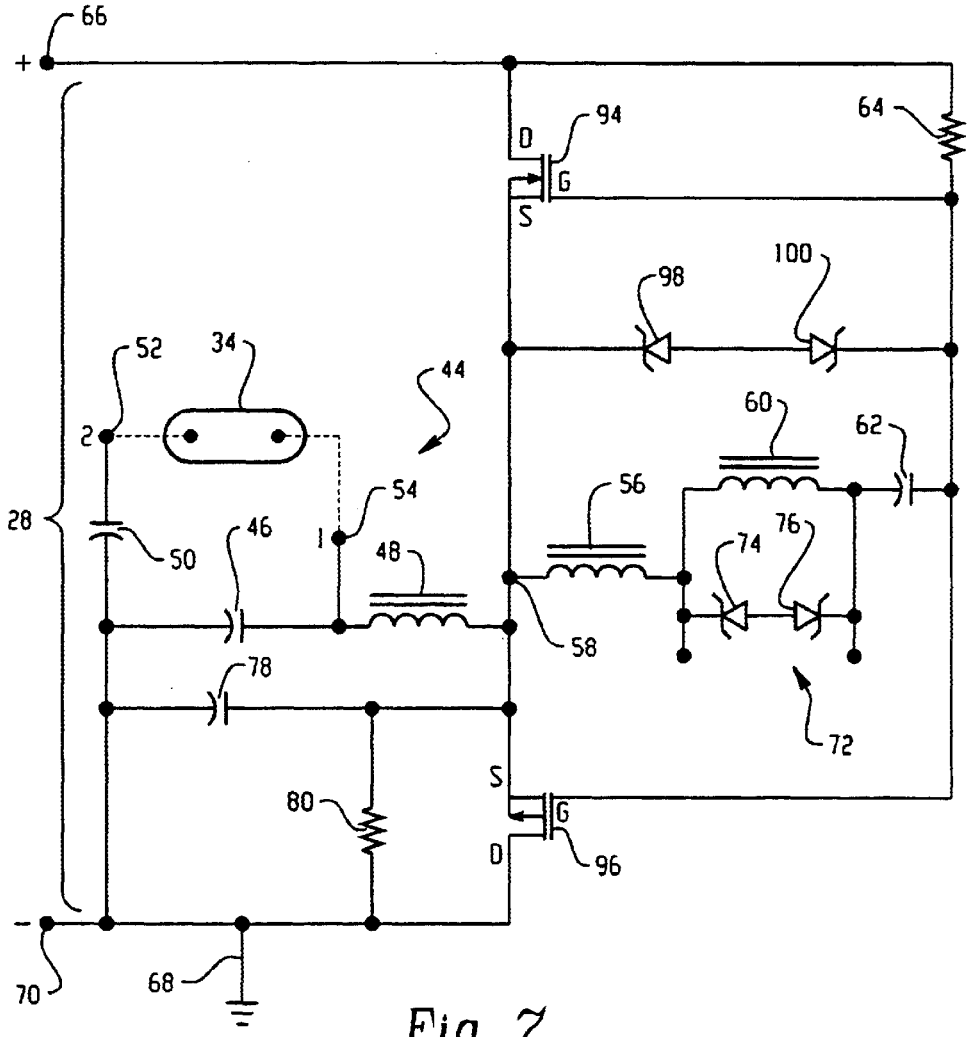
FIG. 7 illustrates an alternate embodiment of the present invention.

An alternate embodiment of the present invention is shown in FIG. 7 incorporating MOSFET switches 94 and 96. With continuing reference to FIG. 4, like numbered numerals in FIG. 7 designate similar components. Omitted in FIG. 7 are reverse-conducting diodes 82 and 84 since MOSFET switches 94 and 96 have intrinsic reverse-conducting diodes. Added in FIG. 7 are gate voltage limiting zener diodes 98 and 100. The BJT switches of FIG. 4 did not require voltage limiting diodes because the base-emitter junction of a BJT inherently limits the input voltage.

In a prior art inverter incorporating complementary MOSFET switches, voltage-limiting zeners 98 and 100 would be configured with equal component voltage ratings. However, in this alternate embodiment of the present invention, zener diodes 98 and 100 are configured with unequal voltage ratings. The unequal voltage ratings cause one of switches 94 and 96 to be in an on state longer than the opposite switch. The effect of unequal on times of switches 94 and 96 will be the same as illustrated in FIGS. 5*a*–5*b* and 6*a*–6*b* for BJT switches 40 and 42.

The beneficial aspect of the asymmetric input line current generated by asynchronous switching of inverter circuits begins to be noticed when even small on/off time imbalances are generated. It is to be noted however, that as the on/off times between, for example, the two switches in the described circuits are increased, a circuit's crest factor will also increase, diminishing the circuit's efficiencies. Therefore, in practical applications users will determine the benefits versus tradeoffs obtainable to provide the most efficient circuit having striations eliminated.

The embodiment shown in FIG. 4 and the embodiment shown in FIG. 7 are for exemplary purposes only. It is to be appreciated that other configurations can be imagined that fall within the scope of the present invention.

As previously noted, while the present invention may be implemented in numerous forms. In the forgoing embodiments, component designations and/or values for the circuits of FIGS. 4 and 7 would include:

| | |
|---|---|
| Transformer Inductor 48 (56 is a tap from 48) | 3.5 mH |
| Transformer Inductor 60 | 150 $\mu$H |
| Capacitor 46 | 1 nF, 1 kV |
| Capacitor 62 | 100 nF, 50 V |
| Capacitor 50 | 100 nF, 500 V |
| Capacitor 78 | 120 pF, 1 kV |
| Diodes 82, 84 each | 1N4937 |
| Zener diode 98 | 9 V |
| Zener diode 100 | 11 V |
| Zener diodes 74, 76 each | 24 V |
| Resistor 64 | 1 Meg |
| Resistor 80 | 1 Meg |
| Transistor 40 | General Electric 13003 |
| Transistor 42 | General Electric 93003 |
| Transistor 94 | IRF310 |
| Transistor 96 | IRF9310 |

It is to be appreciated that, while a variety of lamps may be used, for the values presented, the present lamps would operate on a power supply of line 120/277 Vac at 60 Hertz cycle where the lamps may be a gas discharge lamp such as rare gas filled T8 linear fluorescent. The components listed as STM components are from STMicroelectronics of Catania, Italy. Although the present invention is described primarily in connection with fluorescent lamps, the circuit herein described may be used to control any type of gas discharge lamp. Since certain changes may be made in the above-described circuit without departing from the scope of the invention herein involved, it is intended that all matter contained in the above description or shown in the accompanying drawings shall be interpreted in an illustrative and not a limiting sense.

What is claimed is:

1. A ballast circuit powered by an AC-to-DC convert in operative connection with an input power source, the AC-to-DC converter being configured to produce a DC voltage, the ballast circuit comprising:

a DC bus in operative connection with the AC-to-DC converter, configured to receive the DC voltage;

an inverter circuit configured in operative connection with the DC bus and with a lamp input line, configured to generate an asymmetric alternating current on the lamp input line, the inverter circuit being connected directly to the lamp input line;

wherein the asymmetric alternating current, generated directly on the lamp input line, is provided to a fluorescent lamp being in operative connection with the fluorescent lamp input line to eliminate visual striations otherwise occurring in the lamp.

2. The ballast circuit according to claim 1 wherein the inverter circuit includes:

a switching network including bipolar junction transistor switches wherein the bipolar junction transistors are configured to have unequal on times for producing an asymmetry in the alternating current.

3. The ballast circuit according to claim 2 wherein the bipolar junction transistor switches are configured to have unequal $h_{FE}$ values.

4. The ballast circuit according to claim 1 wherein the inverter circuit includes:

a switching network including MOSFET transistor switch; and back-to-back, series connected zener diodes bridging the gate and source terminals of the MOSFETs, the zener diodes being configured with unequal voltage values from each other causing the MOSFETs to have unequal on times.

5. The ballast circuit according to claim 1 further including:

a DC blocking capacitor configured to block DC current from the asymmetric alternating current.

6. A method of supplying asymmetric alternating current to a gas discharge lamp from a ballast, the method comprising:

converting an AC voltage from an input power source to produce a DC voltage on a DC bus;

inverting said DC voltage to produce an asymmetric alternating current directly on a lamp input line; and supplying a gas discharge lamp with the asymmetric alternating current in operative connection with said lamp input line to eliminate visual striations otherwise occurring in the lamp.

7. The method according to claim 6 wherein said inverting is performed by a switching network including bipolar junction transistor switches wherein the bipolar junction transistors are configured to have unequal on times for producing an asymmetry in the alternating current.

8. The method according to claim 7 wherein the bipolar junction transistor switches are configured to have unequal $h_{FE}$ values.

9. The method according to claim 6 wherein said inverting is performed by a switching network including MOSFET transistor switches; and providing back-to-back, series connected zener diodes bridging the gate and source terminals of the MOSFETs, the zener diodes being configured with unequal voltage values from each other causing the MOSFETs to have unequal on times.

10. The method according to claim 6 further including:

providing a DC blocking capacitor configured to block DC current from the asymmetric alternating current.

11. A ballast circuit powered by an AC-to-DC convert in operative connection with an input power source, the AC-to-DC converter being configured to produce a DC voltage, the ballast circuit comprising:

a DC bus in operative connection with said AC-to-DC converter, configured to receive the DC voltage;

an inverter circuit configured in operative connection with the DC bus and with a lamp input line, configured to generate an asymmetric alternating current on the lamp input line, the inverter circuit being connected directly to the lamp input line;

the inverter circuit including one of bipolar junction transistor switches, wherein the bipolar transistor switches are configured to have unequal on times by having unequal $h_{FE}$ values, and MOSFET transistor switches, wherein th MOSFETs are configured to have unequal on times by providing back-to-back, series connected zener diodes bridging the gate and source terminals of the MOSFETs and configured with unequal voltage values from each other;

wherein the asymmetric alternating current, generated directly on the lamp input line, is provided to a fluorescent lamp being in operative connection with the fluorescent lamp input line to eliminate visual striations otherwise occurring in the lamp.

* * * * *